US010807822B2

(12) United States Patent
Yamaya

(10) Patent No.: US 10,807,822 B2
(45) Date of Patent: Oct. 20, 2020

(54) RECORDING APPARATUS

(71) Applicant: SEIKO EPSON CORPORATION, Tokyo (JP)

(72) Inventor: Keisuke Yamaya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 15/922,364

(22) Filed: Mar. 15, 2018

(65) Prior Publication Data

US 2018/0282098 A1 Oct. 4, 2018

(30) Foreign Application Priority Data

Mar. 31, 2017 (JP) ..... 2017-070264

(51) Int. Cl.

| | |
|---|---|
| ***B65H 23/038*** | (2006.01) |
| ***B65H 18/26*** | (2006.01) |
| ***B41J 15/04*** | (2006.01) |
| ***B65H 19/10*** | (2006.01) |
| ***B65H 18/10*** | (2006.01) |
| ***B65H 18/02*** | (2006.01) |

(52) U.S. Cl.

CPC ..... *B65H 23/038* (2013.01); *B41J 15/04* (2013.01); *B41J 15/042* (2013.01); *B65H 18/028* (2013.01); *B65H 18/10* (2013.01); *B65H 18/26* (2013.01); *B65H 19/10* (2013.01); *B65H 2301/41366* (2013.01); *B65H 2403/942* (2013.01); *B65H 2404/43* (2013.01); *B65H 2404/432* (2013.01); *B65H 2405/42* (2013.01); *B65H 2511/12* (2013.01); *B65H 2801/12* (2013.01)

(58) Field of Classification Search

CPC .... B65H 23/038; B65H 18/028; B65H 18/10; B65H 19/10; B65H 18/26; B65H 2403/942; B65H 2404/432; B65H 2301/41366; B65H 2801/12; B65H 2405/42; B65H 2511/12; B65H 2404/43; B41J 15/042; B41J 15/04

See application file for complete search history.

(56) References Cited

U.S. PATENT DOCUMENTS

| | | | | |
|---|---|---|---|---|
| 5,758,982 | A * | 6/1998 | Yoshida | B41J 29/48 400/708 |
| 2009/0236463 | A1 | 9/2009 | Izumida et al. | |
| 2011/0193927 | A1* | 8/2011 | Matsushima | B41J 2/32 347/218 |
| 2012/0298786 | A1 | 11/2012 | Izumida et al. | |

(Continued)

FOREIGN PATENT DOCUMENTS

| | | | |
|---|---|---|---|
| JP | 10-034987 | A | 2/1998 |
| JP | 2009-227417 | A | 10/2009 |

(Continued)

*Primary Examiner* — William A. Rivera

(74) *Attorney, Agent, or Firm* — Workman Nydegger

(57) ABSTRACT

A recording apparatus includes a printing unit that performs a recording on a sheet, a third sheet feed unit that mounts a roll body on which the sheet is wound in a roll shape, unwinds the sheet from the roll body, and supplies the sheet to the printing unit, and a pressing portion that presses the roll body mounted on the third sheet feed unit, in which the pressing portion presses the mounted roll body in a direction opposite to a direction of taking out the roll body from the third sheet feed unit.

5 Claims, 11 Drawing Sheets

(56) References Cited

U.S. PATENT DOCUMENTS

| | | | | |
|---|---|---|---|---|
| 2013/0161369 | A1* | 6/2013 | Chen | B65H 20/00 226/49 |
| 2014/0197266 | A1 | 7/2014 | Izumida et al. | |
| 2014/0375738 | A1* | 12/2014 | Nagashima | B41J 15/042 347/104 |
| 2016/0137448 | A1 | 5/2016 | Sumioka | |
| 2018/0281481 | A1* | 10/2018 | Yamaya | B41J 13/26 |
| 2018/0282085 | A1* | 10/2018 | Kinoshita | B65H 9/006 |
| 2019/0291481 | A1* | 9/2019 | Yazawa | B41J 15/04 |

FOREIGN PATENT DOCUMENTS

| | | | | |
|---|---|---|---|---|
| JP | 2016-098059 | A | 5/2016 | |
| JP | 6202648 | B1 * | 9/2017 | B65H 16/08 |

* cited by examiner

RECORDING APPARATUS

BACKGROUND

1. Technical Field

The present invention relates to a recording apparatus having a recording unit that records on a recording medium.

2. Related Art

In the related art, for example, there is a recording apparatus that includes a liquid ejecting head that ejects a liquid such as an ink as a recording unit, ejects the liquid onto a recording medium such as a sheet and the like which is unwound and supplied from a roll body on which the recording medium is wound in a roll form, and records (prints) an image including a character, a figure, and the like on a recording medium.

In such a recording apparatus, for example, by setting (mounting) a roll sheet on a supplying apparatus by a spool member and pressing an outer periphery of the roll sheet with a driven rotating body (pressure contact body), there is an apparatus that has a configuration of suppressing an occurrence of slackening of the sheet and discharging (supplying) a terminal edge portion of the sheet by using a rotation of the roll sheet (for example, refer to JP-A-2016-98059).

However, in a recording apparatus in the related art, a driven rotating body is pressed in a direction (upward) opposed to a setting direction of a roll sheet. Therefore, it is required to provide a locking mechanism of a spool member, a mechanism for adjusting a pressing force of the driven rotating body, and the like so that the roll sheet is not moved (does not rise) by the pressing force of the driven rotating body from the state where the roll sheet is set, and for example, there is a problem that a size of the recording apparatus is increased.

SUMMARY

An advantage of some aspects of the invention is to provide a recording apparatus which can easily maintain a state where a roll body is mounted.

Hereinafter, means of the invention and operation effects thereof will be described.

According to an aspect of the invention, there is provided a recording apparatus including a recording unit that performs a recording on a recording medium, a medium supply unit that mounts a roll body on which the recording medium is wound in a roll shape, unwinds the recording medium from the roll body, and supplies the recording medium to the recording unit, and a pressing portion that presses the roll body mounted on the medium supply unit, in which the pressing portion presses the mounted roll body in a direction opposite to a direction of taking out the roll body from the medium supply unit.

According to this configuration, it is possible to easily maintain the roll body in a state of being mounted.

In the recording apparatus, it is preferable that the pressing portion press the roll body in a direction deviated from a center of the roll body toward a downstream side in a feeding direction of the recording medium when the recording medium is unwound from the roll body mounted on the medium supply unit and supplied to the recording unit.

According to this configuration, it is possible to suppress the recording medium wound in the roll shape from unwinding by the pressing portion.

In the recording apparatus, it is preferable that the pressing portion be attached to a rocking lever that can rock around a rocking axis, and a distance between the rocking axis of the rocking lever and the pressing portion be longer than a distance between the rocking axis of the rocking lever and a cylindrical shaft of the roll body.

According to this configuration, the pressing portion attached to the rocking lever is easy to press the roll body in the direction to be the downstream side in the feeding direction of the recording medium.

It is preferable that the recording apparatus further include an opening/closing cover that is movable between a closed position covering the mounted roll body and an open position exposing the mounted roll body, and the pressing portion press the roll body in conjunction with a movement of the opening/closing cover to the closed position.

According to this configuration, by closing the cover after the roll body is mounted on the medium supply unit, it is possible to reliably press the pressing portion against the mounted roll body.

In the recording apparatus, it is preferable that a plurality of the pressing portions be disposed at intervals in a width direction intersecting a feeding direction of the recording medium supplied to the recording unit, and the intervals be different from each other depending on positions in the width direction.

According to this configuration, it is possible to appropriately press the roll bodies of a plurality of recording media having different lengths in the width direction by the pressing portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printer according to one embodiment will be described with reference to the drawings.

Figure 1:
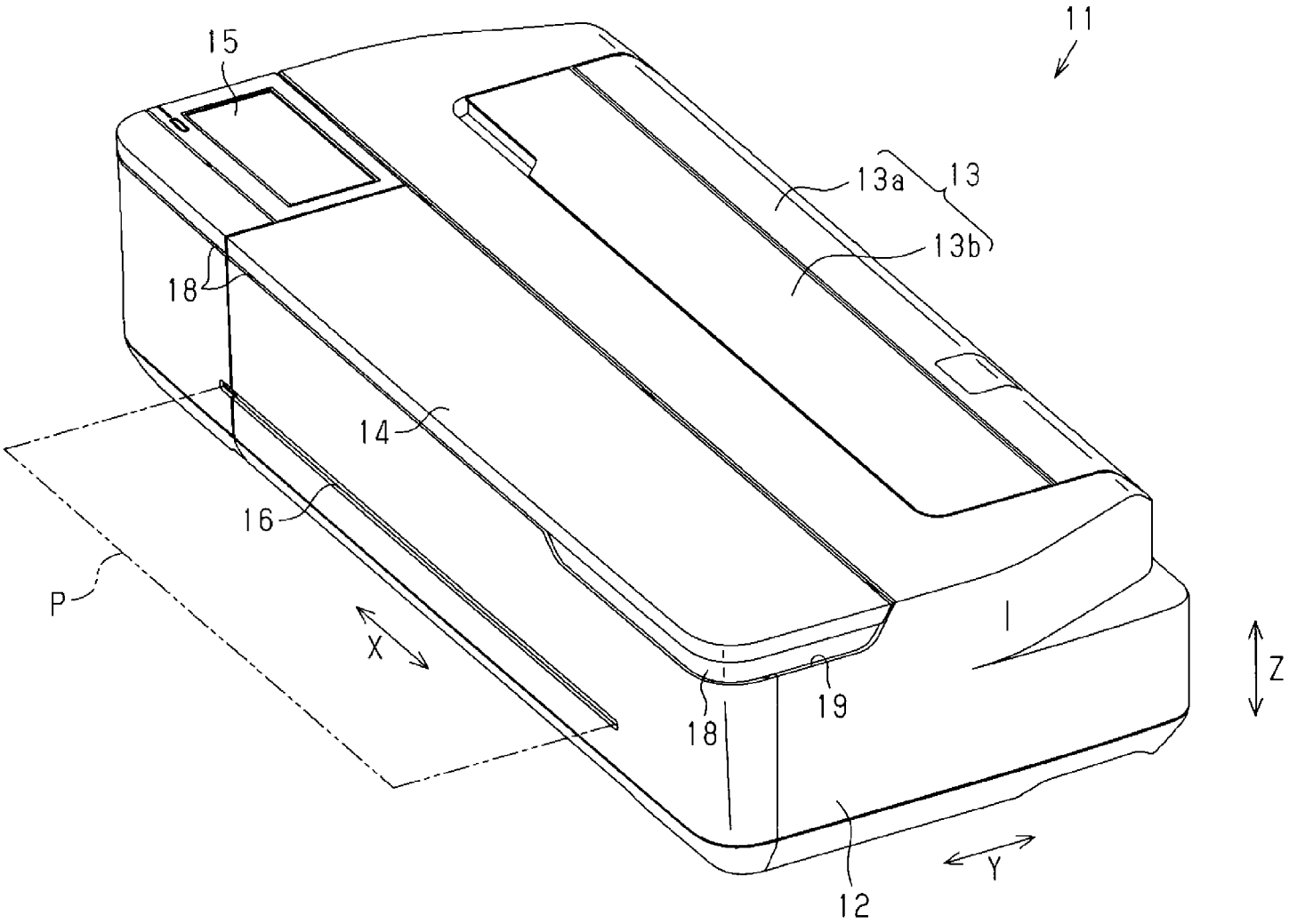
FIG. 1 is a perspective view of a printer according to one embodiment.

In the following description, assuming that a printer 11 illustrated in FIG. 1 is placed on a horizontal plane, a direction along a vertical direction is illustrated as a vertical direction Z, and a direction along a horizontal plane intersecting (orthogonal to) the vertical direction Z is illustrated as a width direction X and a depth direction Y. That is, the width direction X, the depth direction Y, and the vertical direction Z are different directions from each other and intersect each other (preferably orthogonal to). One end side in the depth direction Y is referred to as a front side, the other end side opposite to the one end side is referred to as a rear side, and one end side of the width direction X viewed from the front side may be referred to as a right side and the other end side may be referred to as a left side.

As illustrated in FIG. 1, the printer 11 is an example of a recording apparatus that records (prints) an image including a character, a figure, and the like by a recording unit with respect to a sheet P serving as an example of a recording medium, and is provided with a substantially rectangular parallelepiped casing 12. On an upper surface of the casing 12, a sheet feed cover 13 serving as an example of an opening/closing cover positioned on the rear side is provided so as to be movable between an open position where an inside of the casing 12 is exposed and a closed position where the inside of the casing 12 is not exposed. The sheet feed cover 13 includes a first cover 13*a* rotatably attached to the casing 12 by a shaft 13*c* (refer to FIG. 4) and a second cover 13*b* rotatably attached to the first cover 13*a* by a hinge 13*d* (refer to FIG. 2).

In addition, on the upper surface of the casing 12, a maintenance cover 14 is provided on the front side, and an operation panel 15 that performs various operations of the printer 11 is provided at a position adjacent to the maintenance cover 14 in the width direction X on the upper surface of the casing 12. The operation panel 15 of the embodiment is a touch panel, for example, and can display and input information. In addition, the operation panel 15 is provided so as to be rotatable around a rotation axis (not illustrated) provided on the front side, and is capable of changing a posture between an upright posture and a tilted posture.

A discharge port 16 through which the printed sheet P is discharged is provided on the front surface of the printer 11. In addition, a dent 18 is formed over the width direction X on the front surface of the printer 11. The lower end of the maintenance cover 14 is recessed so as to be positioned inside from the front surface and the right surface of the casing 12, so that a portion of the dent 18 is formed at a boundary between the maintenance cover 14 and the casing 12.

The casing 12 has a recessed portion 19 of which a height in the vertical direction Z is lower than the left end provided with the operation panel 15 and the center portion at a right end position in the width direction X. Therefore, a width of the dent 18 in the vertical direction Z is larger in the portion corresponding to the recessed portion 19 than that in the other portion.

In the printer 11 of the embodiment, images can be printed on a plurality of types of sheet P such as a roll sheet P3 unwound from a roll body RT (refer to FIG. 4), a second cut sheet P2 (refer to FIG. 2) cut in a rectangular shape, and a first cut sheet P1 (refer to FIG. 3) whose area is smaller than the second cut sheet P2.

Figure 4:
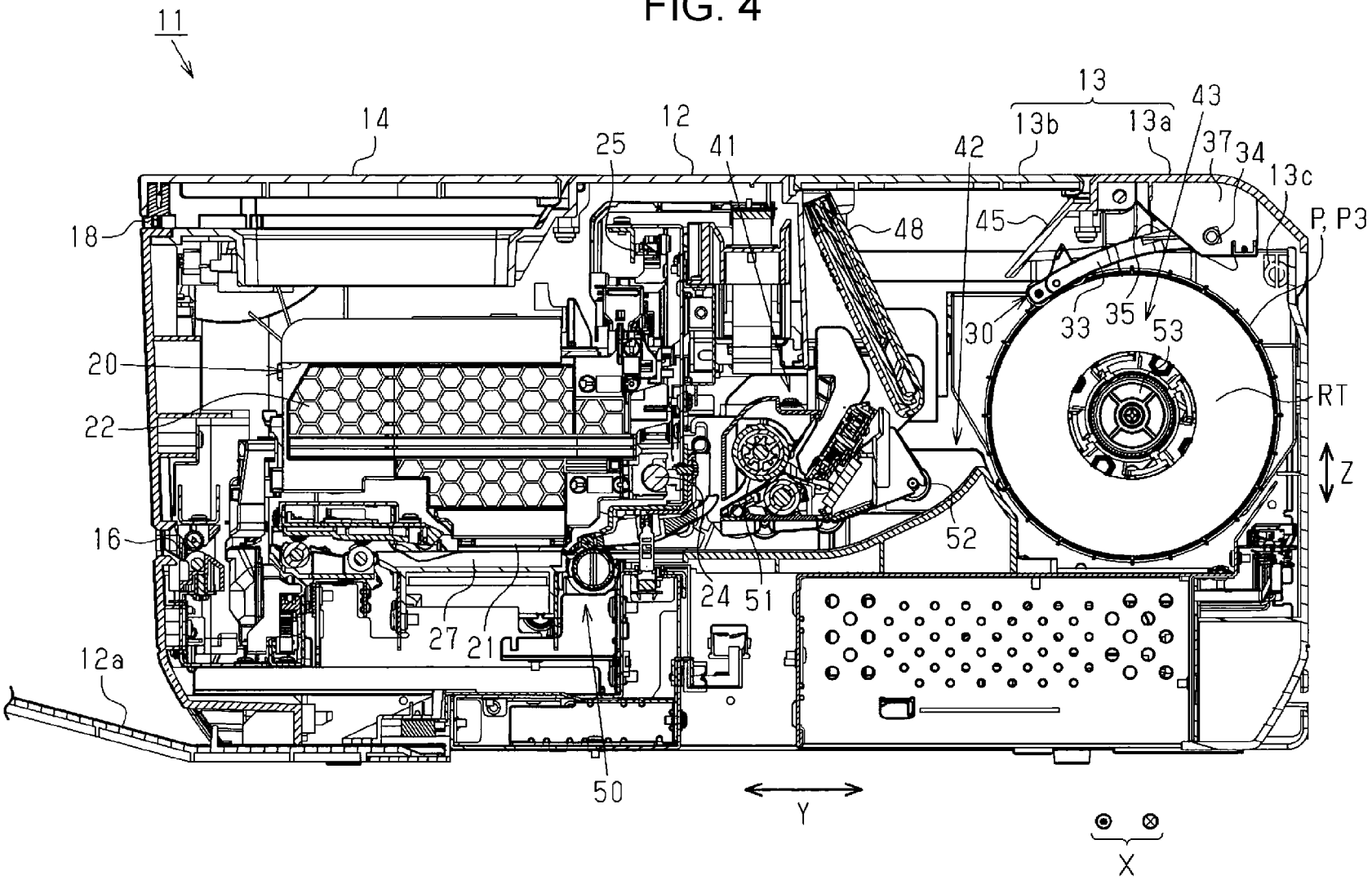
FIG. 4 is a cross-sectional view illustrating an internal structure of the printer.

That is, as illustrated in FIGS. 1 and 4, in the printer 11, the roll body RT on which the sheet P is wound in a roll is mounted on the rear side in the depth direction Y of the casing 12, and is accommodated in the casing 12 in a state where the upper portion is covered by the sheet feed cover 13. The sheet P (that is, roll sheet P3) unwound from the accommodated roll body RT is supplied to a printing unit 20 serving as an example of the recording unit provided in the printer 11.

Figure 2:
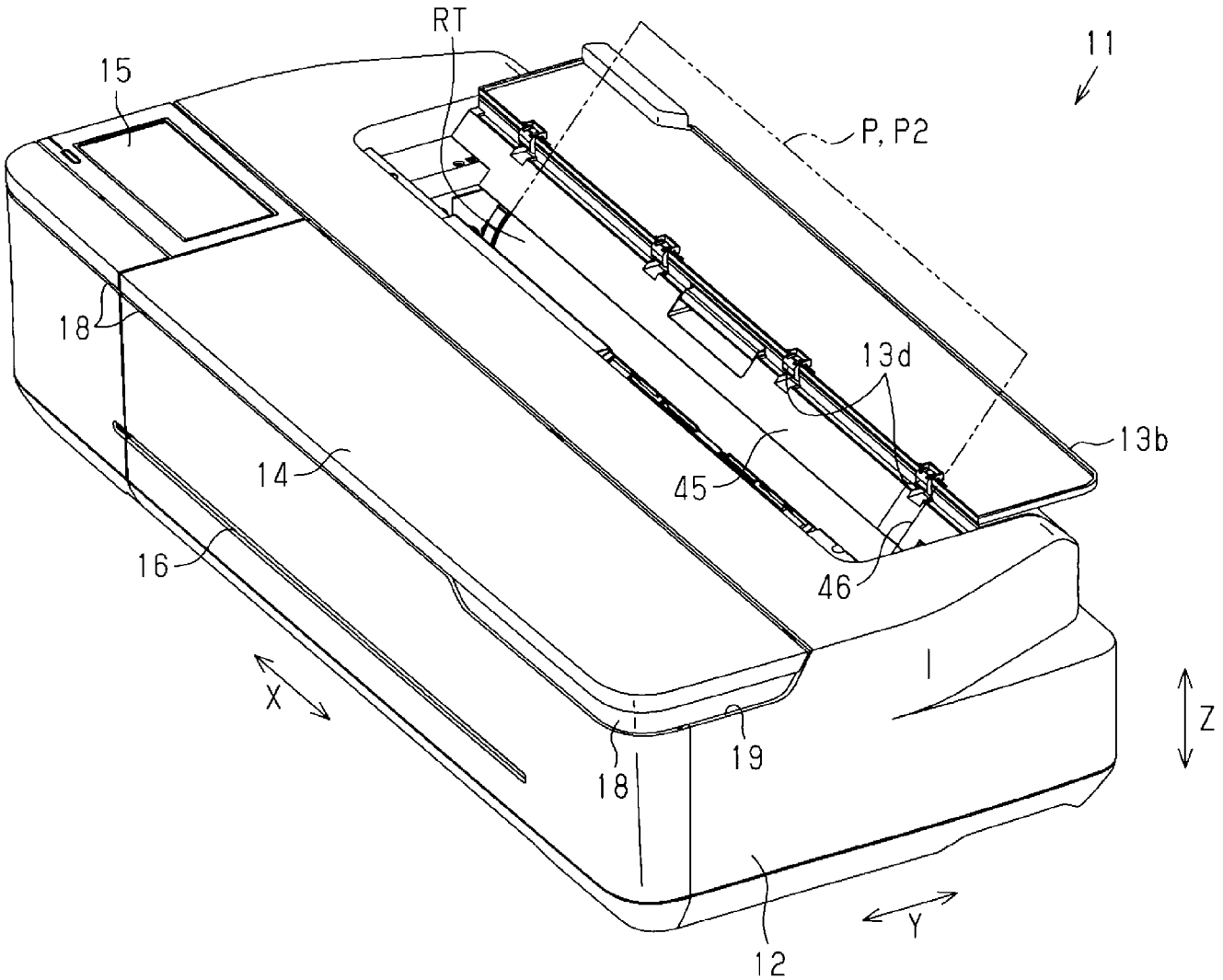
FIG. 2 is a perspective view of the printer in a state where a recording medium can be supplied by manual insertion.

In addition, as illustrated in FIG. 2, in the sheet feed cover 13 of the printer 11, a portion which is covered with the second cover 13*b* among the upper surface of the casing 12 is opened to form an opening portion in a second state where the first cover 13*a* is positioned at the closed position and the second cover 13*b* is positioned at the open position. It is possible to insert the second cut sheet P2 by manual insertion at a position in front of the roll body RT mounted on the casing 12 from the opening portion. The sheet feed cover 13 has a guide portion 45 that guides the insertion while supporting the second cut sheet P2 inserted from the opening portion at this time. Furthermore, the guide portion 45 has an edge guide 46 that guides the end of the second cut sheet P2. The second cut sheet P2 inserted from the opening portion is supplied to the printing unit 20.

Figure 3:
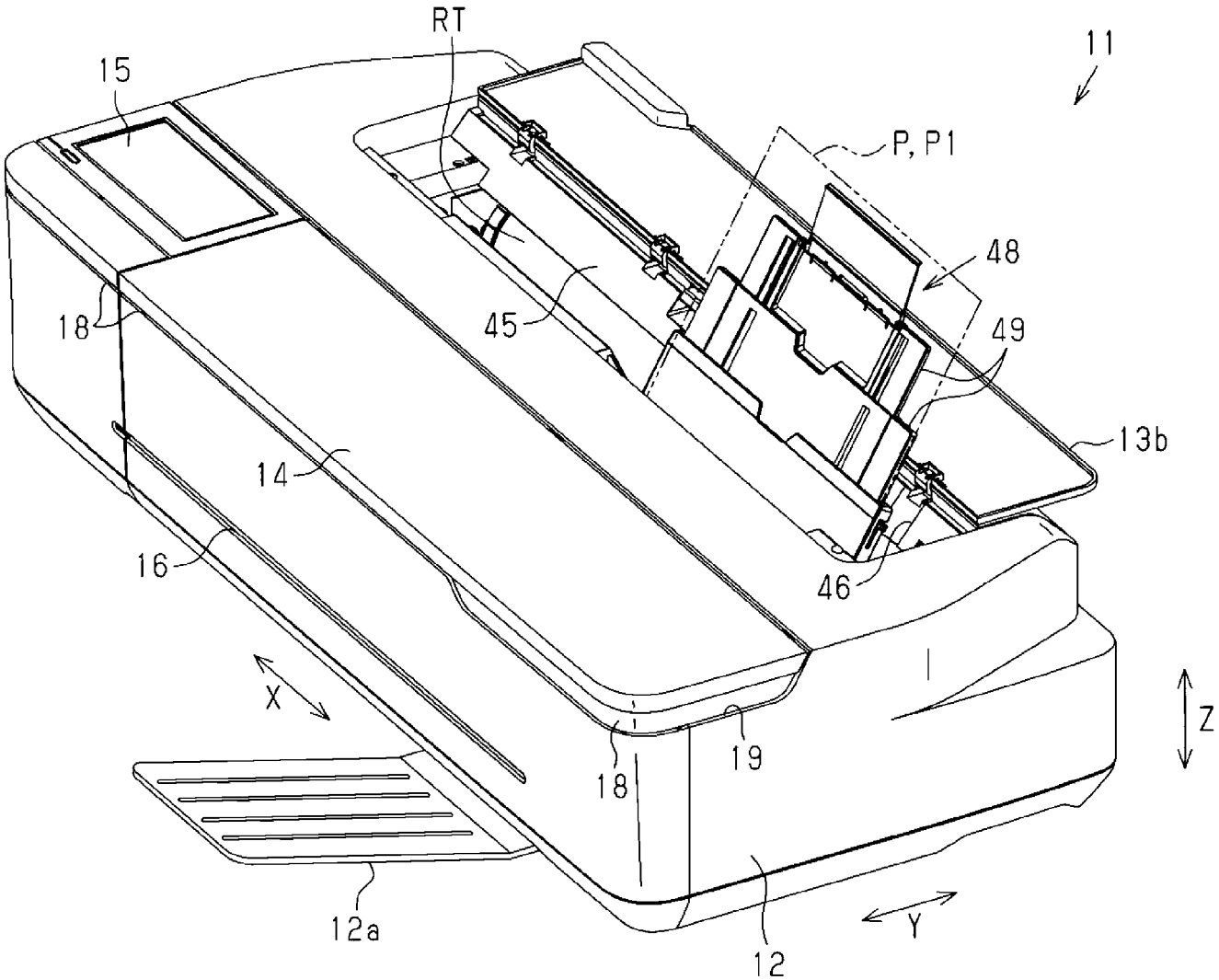
FIG. 3 is a perspective view of the printer in a state where the recording medium can be supplied from a sheet feed tray.

In addition, as illustrated in FIG. 3, in the second state where the second cover 13*b* is positioned at the open position, the printer 11 is provided with a sheet feed tray 48 which is extendable and contractible so as to be drawn out from the opening portion on the upper surface of the casing 12, and is rotatable so as to be in a rearward tilted posture fallen to the rear side. In a case where feeding the first cut sheet P1, the sheet feed tray 48 is drawn out from the opening portion and is in the rearward tilted posture fallen to the rear side.

Specifically, the sheet feed tray 48 is configured by combining a plurality of guide plates 49 having different sizes. With this configuration, the sheet feed tray 48 expands and contracts by drawing out a small size guide plate 49 from a large size guide plate 49 or accommodating the small size guide plate 49 in the large size guide plate 49. The sheet feed tray 48 can mount the first cut sheet P1 in a state where the guide plate 49 is drawn out and is in the rearward tilted posture. That is, it is possible to mount a plurality of first cut sheets P1 in a stacked state on the sheet feed tray 48 and the first cut sheet P1 stacked on the sheet feed tray 48 is supplied one by one to the printing unit 20.

In addition, as illustrated in FIG. 3, a mounted table 12*a* on which the first cut sheet P1 supplied from the sheet feed tray 48, printed by the printing unit 20, and discharged from the discharge port 16 is mounted is attached to the front side of the casing 12 by being inserted into the bottom of the casing 12 as necessary (refer to FIG. 4).

As illustrated in FIGS. 2 and 3, in the second state where the first cover 13*a* is positioned at the closed position and the second cover 13*b* is positioned at the open position, regardless of the expansion and contraction of the guide plate 49, the sheet feed tray 48 is in a forward tilted posture, so that the second cut sheet P2 can be fed to the printing unit 20. Furthermore, the sheet feed tray 48 is in the rearward tilted posture, so that the first cut sheet P1 can be fed to the printing unit 20.

As illustrated in FIG. 4, the printer 11 is provided with a first sheet feed unit 41 that supplies the first cut sheet P1 (sheet P), a second sheet feed unit 42 that supplies the second cut sheet P2 (sheet P), and a third sheet feed unit 43 that feeds the roll sheet P3 (sheet P) unwound from the roll body RT to the printing unit 20. In the embodiment, the first sheet feed unit 41, the second sheet feed unit 42, and the third sheet feed unit 43 function as a medium supply unit that supplies the sheet P to the printing unit 20.

The first sheet feed unit 41 is provided with a sheet feed roller 51 that feeds the uppermost first cut sheet P1 among the first cut sheet P1 mounted on the sheet feed tray 48 in a stacked state. In addition, the second sheet feed unit 42 is provided with a guide roller 52 that guides the second cut sheet P2 when the second cut sheet P2 set one by one on the guide portion 45 is supplied to the printing unit 20.

The third sheet feed unit 43 rotatably holds the roll body RT having a cylindrical shape, is provided with a sheet feed shaft 53 serving as an example of the cylindrical shaft of the roll body RT, unwinds the roll sheet P3 (sheet P) from the roll body RT by rotating the sheet feed shaft 53 in one direction (counterclockwise direction in FIG. 4), and supplies (feeds) the roll sheet P3 to the printing unit 20. The third sheet feed unit 43 is capable of feeding the roll sheet P3 to the printing unit 20 in a first state where the first cover 13*a* and the second cover 13*b* are in a closed position.

Figure 5:
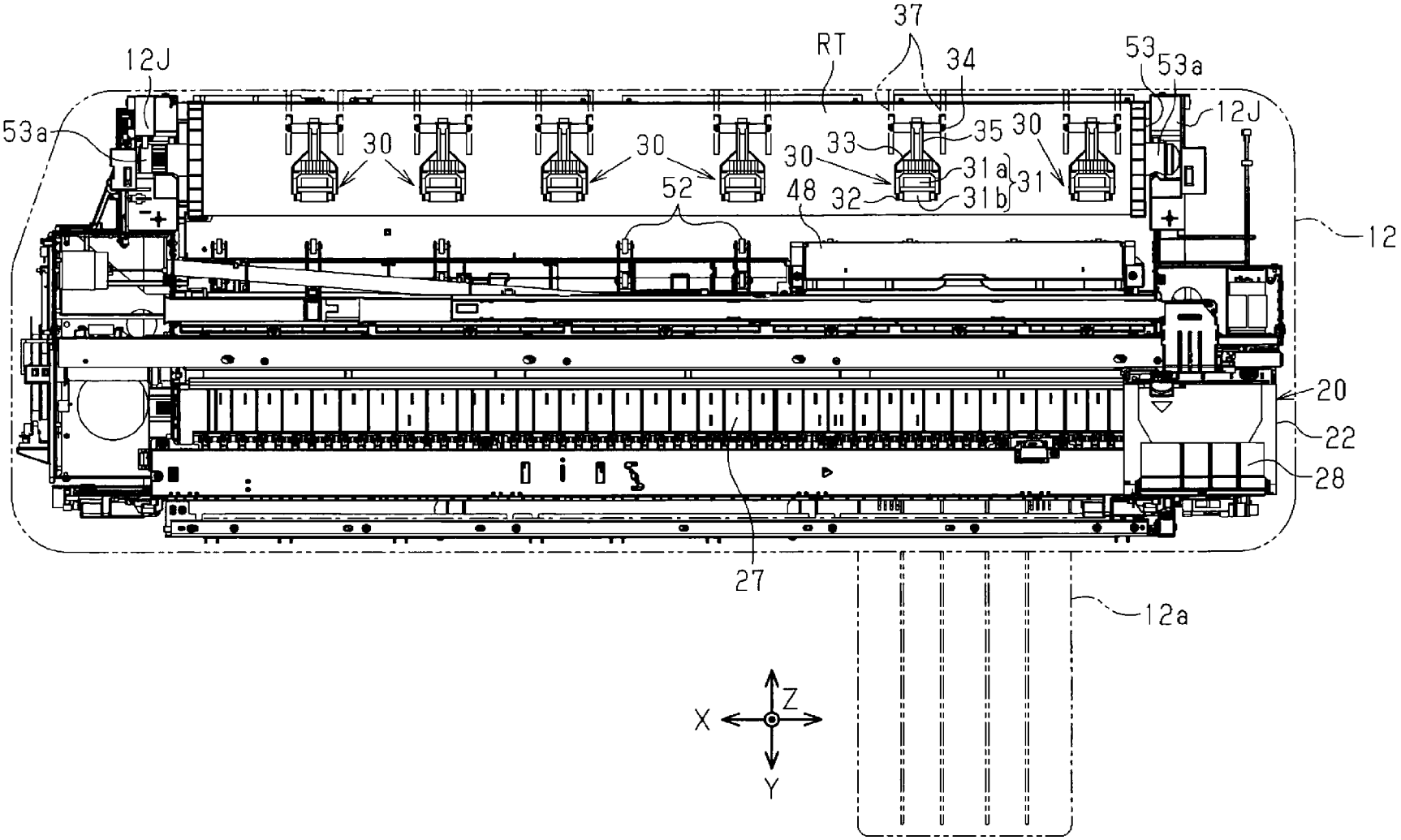
FIG. 5 is a plan view illustrating the internal structure of the printer.

As illustrated in FIG. 5, in the third sheet feed unit 43, in the roll body RT, shaft end portions 53*a* on both sides of the sheet feed shaft 53 around which the roll sheet P3 is wound are inserted from an upper side and mounted on a bearing portion 12J provided in the casing 12. A plurality of a pressing portions 30 that press the roll body RT mounted on the third sheet feed unit 43 are provided along the axial direction of the sheet feed shaft 53. Each of the pressing portions 30 presses the roll body RT (specifically, roll sheet P3 wound in a roll on outermost periphery) from the same upper side as the insertion direction at the time of mounting the roll body RT. In FIG. 5, the internal structure of the printer 11 is illustrated in a state where the casing 12 and the mounted table 12*a* are removed.

As illustrated in FIGS. 4 and 5, the printing unit 20 to which the sheet P is supplied has a discharge head 21 serving as an example of a recording head to records on the sheet P, and a carriage 22 serving as an example of a head moving portion which is provided with the discharge head 21 and is movable in a direction intersecting a transport direction. A support portion 27 supporting each the sheet P supplied from the first sheet feed unit 41, the second sheet feed unit 42, and the third sheet feed unit 43 is provided in the casing 12, and an image or the like is recorded (printed) by discharging a liquid such as ink from the discharge head 21 provided in the printing unit 20 on the sheet P supported by the support portion 27.

Specifically, as illustrated in FIG. 4, the printer 11 has a main guide shaft 24 and a sub guide shaft 25 that guide the movement of the carriage 22. The main guide shaft 24 and the sub guide shaft 25 are provided at the rear side of the carriage 22 along the width direction X (scanning direction). In addition, the sub guide shaft 25 is provided at a position higher than the main guide shaft 24. The carriage 22 is slidably fitted to the main guide shaft 24 from the front side and is slidably in contact with the plate-like sub guide shaft 25 from the rear side. The main guide shaft 24 and the sub guide shaft 25 are provided at intervals in the vertical direction Z, so that a tilt (for example, forward tilt) in a direction intersecting the vertical direction Z of the printing unit 20 (carriage 22) is suppressed.

In addition, in the embodiment, as illustrated in FIG. 5, in the carriage 22, at least one liquid container 28 (four in the embodiment) that store a liquid is detachably mounted. The printing unit 20 discharges the liquid supplied from the liquid container 28 from a plurality of nozzles (not illustrated) provided in the discharge head 21 and prints on the sheet P. In addition, in the printer 11, a maintenance portion (not illustrated) maintaining the discharge performance of the liquid from the printing unit 20 is provided at a home position (in the embodiment, as illustrated in FIG. 5, position at right end of width direction X in casing 12) where the sheet P and the printing unit 20 do not face each other.

As illustrated in FIG. 4, the printer 11 has a transport portion 50 having a pair of rollers transporting the sheet P supplied from each sheet feed unit from the upstream side which is the side opposite to the discharge port 16 side with respect to the printing unit 20 toward the downstream side which is the discharge port 16 side.

Next, the configuration of the pressing portion 30 of the third sheet feed unit 43 will be described.

Figure 6:
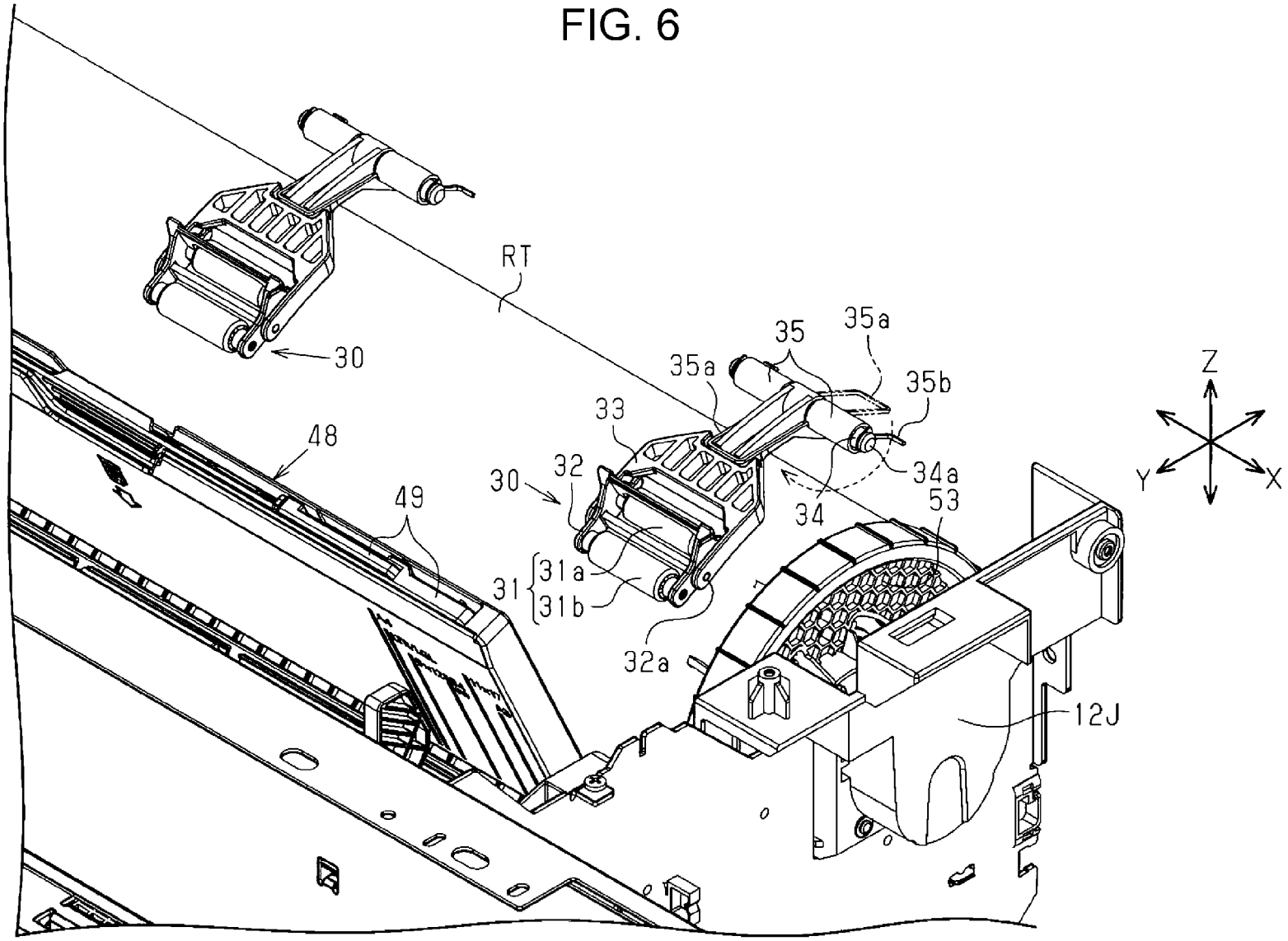
FIG. 6 is an enlarged perspective view showing a part of the internal structure of the printer.

As shown in FIGS. 5 and 6, the pressing portion 30 has a cylindrical (columnar) roller 31 and a roller holding body 32 for holding the roller 31. In the embodiment, the rollers 31 have two rollers of a roller 31*a* on the upstream side and a roller 31*b* on the downstream side in the feeding direction of the roll sheet P3 from the roll body RT, with the direction of the axis of the cylindrical shaft (column shaft) as a width direction X. The two rollers 31*a* and 31*b* are rotatably held by the roller holding body 32 at the shaft ends on both sides of the respective cylindrical shaft (column shaft).

In the third sheet feed unit 43, a lever body 33 to which the pressing portion 30 is attached and a biasing member 35 to bias the lever body 33 are provided corresponding to each pressing portion 30. The lever body 33 is formed with a shaft portion 34 extending in a cylindrical shape on both sides so as to have a T shape on a base end side opposite to a tip end side having the Y shape. In the lever body 33, shaft ends 34*a* on both sides of the shaft portion 34 are inserted into shaft holes provided in a pair of rib shaped walls 37 (refer to FIG. 4) formed in the first cover 13*a*, and the lever body 33 can rock around the shaft end 34*a*. Therefore, the shaft portion 34 to which the shaft ends 34*a* on both sides thereof are attached so as to be capable of rocking with respect to the first cover 13*a* (sheet feed cover 13), functions as a rocking axis, and the lever body 33 capable of rocking around the shaft portion 34 functions as a rocking lever.

The pressing portion 30 is attached to the lever body 33 which is capable of rocking around the shaft portion 34. Specifically, in the roller holding body 32 of the pressing portion 30, a projecting portion 32*a* provided at an intermediate position between the shaft ends of the two held rollers is inserted into the shaft hole provided in a Y-shaped portion formed on the tip end side of the lever body 33, so that the roller holding body 32 is rotatably attached to the lever body 33.

The biasing member 35 is a wound coil on both sides with a central portion 35*a* having a C shape interposed therebetween, and the coil ends 35*b* of the respective wound coils has an L shape. In the biasing member 35, the wound coils on both sides are covered on the shaft portion 34 of the lever body 33, and a coil end 35*b* is locked to the rib shaped wall 37, and the central portion 35*a* is attached to the lever body 33 in a state of being rotated as shown by a broken line arrow from a position shown by the two-dot chain line in FIG. 6 to a position shown by the solid line in FIG. 6. That is, the biasing member 35 functions as a torsion spring in which the wound coil portion is twisted as the central portion 35*a* rotates in this manner, and due to a biasing force of the central portion 35*a* caused by the twisting of the wound coil portion, the lever body 33 is biased so as to rotate in a direction to press the roller 31 against the roll body RT around the shaft portion 34. Therefore, the roller 31 presses the roll body RT with a pressing force corresponding to the biasing force of the biasing member 35.

In the embodiment, the pressing portion 30 moves in conjunction with the movement of the sheet feed cover 13 (first cover 13*a*) that is movable between the closed position covering the mounted roll body RT and the open position exposing the mounted roll body RT. The pressing portion 30 releases the pressing of the roll body RT in a state where the sheet feed cover 13 is moved to the open position, and presses the roll body RT in a state where the sheet feed cover 13 is moved to the closed position (that is, in a first state where the first cover 13*a* and the second cover 13*b* are positioned at the closed position).

Figure 7:
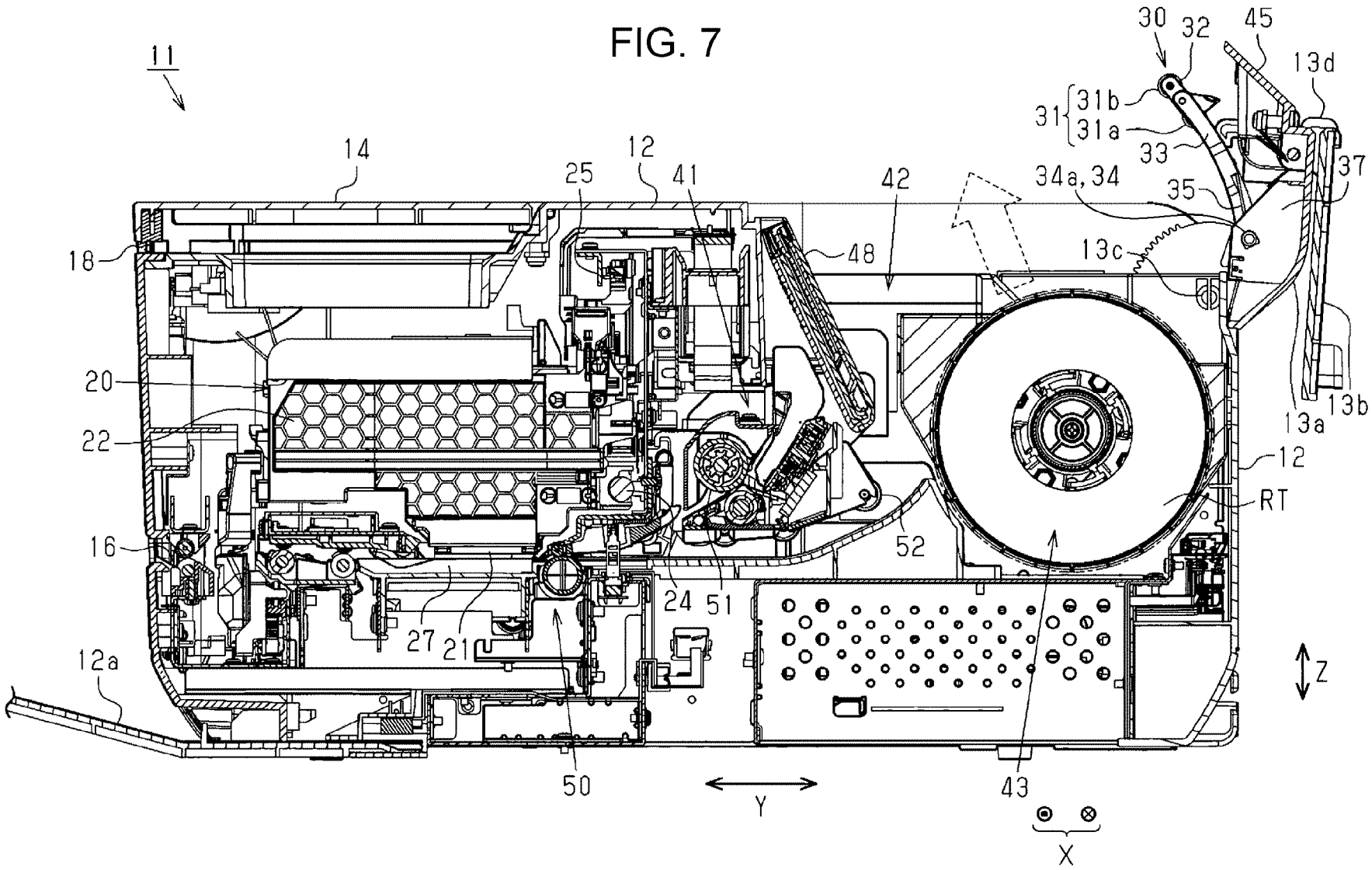
FIG. 7 is a cross-sectional view of a printer in a state where an opening/closing cover is opened.
Figure 8:
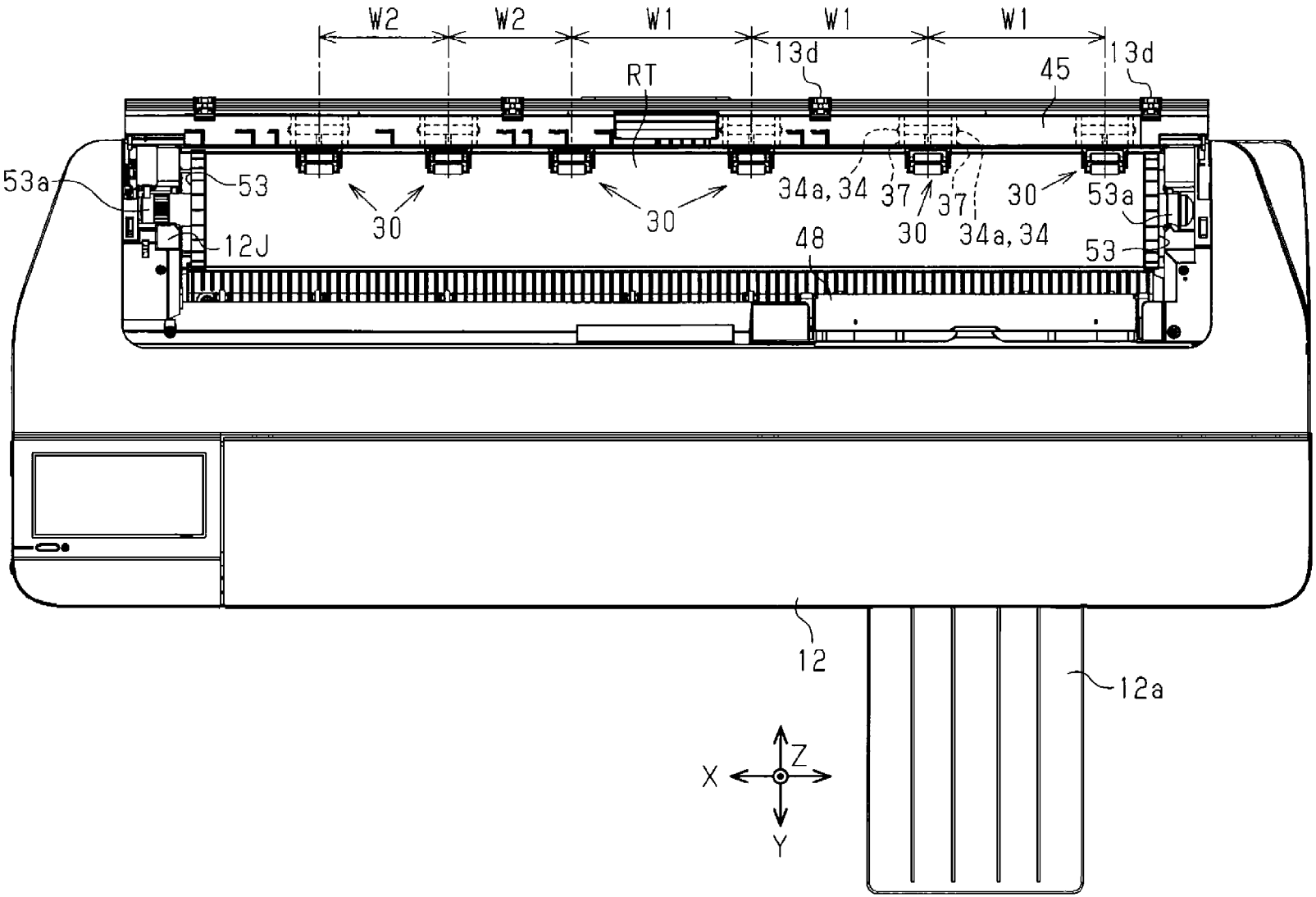
FIG. 8 is a plan view showing a disposition configuration of a pressing portion.

That is, as shown in FIGS. 7 and 8, in a state where the first cover 13*a* and the second cover 13*b* are moved to the open position, the first cover 13*a* and the second cover 13*b* enter a third state where the upper portion of the third sheet feed unit 43 is opened in addition to the first sheet feed unit 41 and the second sheet feed unit 42. In the third state, the lever body 33 attached to the first cover 13*a* moves to the open position of the first cover 13*a* and separates from the roll body RT, and the pressing portion 30 attached to the lever body 33 releases the pressing against the roll body RT.

In the embodiment, in the third state, as shown by a hollow broken-line arrow in FIG. 7, the shaft end portions 53*a* on both sides of the sheet feed shaft 53 are pulled upward from a bearing portion 12J in the roll body RT. Therefore, in the roll body RT, the upward direction side in the vertical direction Z is a taking-out direction, and the user pulls the shaft end portion 53*a* upward from the bearing portion 12J, so that the roll body RT can be taken out from the third sheet feed unit 43 and the user can set (mount) and exchange the roll body RT.

On the other hand, as shown in FIG. 4, in a state (first state) where the first cover 13*a* and the second cover 13*b* are positioned at the closed position, the lever body 33 attached to the first cover 13*a* approaches the roll body RT together with the movement of the first cover 13*a*, and the pressing portion 30 attached to the lever body 33 comes in contact with the mounted roll body RT from above. The contacting pressing portion 30 presses the roll body RT downward by the biasing force of the biasing member 35. That is, the pressing portion 30 is in a state of pressing the roll body RT in conjunction with the movement of the sheet feed cover 13 (first cover 13*a*) to the closed position, so that it is possible to feed the roll sheet P3 to the printing unit 20. At this time, the pressing portion 30 presses the roll body RT in a direction opposite to the direction of taking out from the third sheet feed unit 43, that is, downward direction in the vertical direction Z.

In the printer 11 of the embodiment, at least two types of sheet P (roll sheet P3) having different lengths (widths) in the width direction X from the third sheet feed unit 43 are supplied to the printing unit 20. Therefore, the plurality of pressing portions 30 attached to the first cover 13*a* have different intervals between the adjacent pressing portions 30 depending on the position in the width direction X intersecting the feeding direction of the sheet P supplied to the printing unit 20 which is an axial direction of the sheet feed shaft 53.

As shown in FIG. 8, in the embodiment, sixth pressing portions 30 are disposed along the width direction X. The interval W1 between the centers of the adjacent pressing portions 30 from a first pressing portion 30 positioned on the rightmost side in the width direction X to a fourth pressing portion 30 positioned on the left side thereof is wider than the interval W2 between the centers of the adjacent pressing portions 30 from the fourth pressing portion 30 to a sixth pressing portion 30 on the left side thereof. In this manner, the interval between the pressing portions 30 is made different corresponding to the position in the width direction X of the pressing portion 30, so that the roller 31 of the pressing portion 30 presses the roll body RT wound with the roll sheet P3 having different widths at an appropriate position in the width direction X.

Incidentally, in the embodiment, the roll sheets P3 having 24 inches and the roll sheets P3 having 36 inches in length in the width direction X are supplied to the printing unit 20. The roll body RT on which the roll sheet P3 having 24 inches is wound is pressed by the pressing portion 30 from the first portion positioned on the rightmost side in the width direction X to the fourth portion positioned on the left side thereof, and the roll body RT on which the roll sheet P3 having 36 inches is wound is pressed by the entire pressing portions 30 from the first portion positioned on the rightmost side in the width direction X to the sixth portion positioned on the left side thereof.

In addition, in the embodiment, each of the pressing portions 30 disposed as described above is configured to press the roll body RT from the center of the roll body RT toward a direction deviated on the downstream side in the feeding direction of the roll sheet P3 when unwound from the roll body RT mounted on the third sheet feed unit 43 and supplied to the printing unit 20. This configuration will be described with reference to the drawings.

Figure 9:
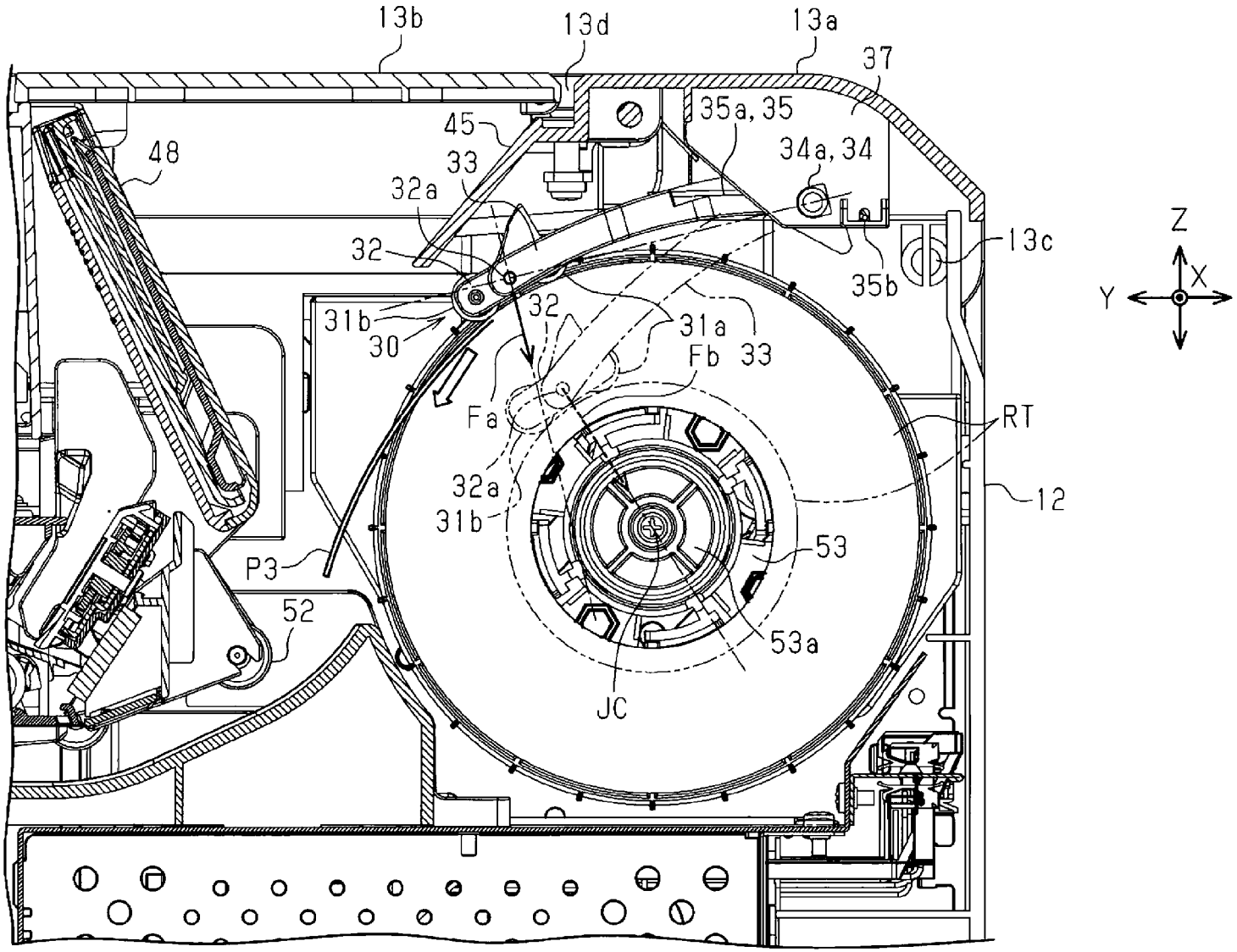
FIG. 9 is an enlarged side view showing the pressing portion pressing a roll body.

As shown in FIG. 9, at the time of start of sheet feeding to start the feeding of the roll sheet P3 from the unused new roll body RT to the printing unit 20, in the pressing portion 30 pressing the roll body RT having the maximum diameter, the biasing force Fa is applied to the projecting portion 32*a* provided on the roller holding body 32 by the lever body 33 biased by the central portion 35*a* of the biasing member 35. As a result, the rollers 31*a* and 31*b* held by the roller holding body 32 press the roll body RT with a pressing force corresponding to the biasing force Fa.

At this time, as shown by a solid arrow in FIG. 9, the biasing direction of the biasing force Fa applied to the projecting portion 32*a* is a direction orthogonal to the direction of the straight line connecting the center of the shaft ends 34*a* on both sides of the shaft portion 34 of the lever body 33 and the center of the projecting portion 32*a* provided on the roller holding body 32. The orthogonal direction is a direction deviated from an axis JC of the sheet feed shaft 53 (shaft end portion 53*a*), which is the center of the roll body RT toward the downstream side in the feeding direction (direction shown by hollow solid arrow in FIG. 9) moving along with the rotation (normal rotation) of the roll body RT when the portion of the roll sheet P3 in contact with the rollers 31*a* and 31*b* is supplied to the printing unit 20.

In addition, as shown by the two-dot chain line in FIG. 9, at the end of the sheet feeding at which the unwound roll sheet P3 runs out, in the pressing portion 30 pressing the roll body RT having the minimum diameter, the biasing force Fb is applied to the projecting portion 32*a* provided on the roller holding body 32 by the lever body 33 biased by the central portion 35*a* of the biasing member 35 as shown by the broken line arrow in FIG. 9. As a result, the rollers 31*a* and 31*b* held by the roller holding body 32 press the roll body RT with a pressing force corresponding to the biasing force Fb.

At this time, similar to the time of start of sheet feeding, the biasing direction of the biasing force Fb applied to the projecting portion 32*a* is a direction deviated from the axis JC of the sheet feed shaft 53 (shaft end portion 53*a*) of the roll body RT toward the downstream side in the feeding direction when the portion of the roll sheet P3 in contact with the rollers 31*a* and 31*b* is supplied to the printing unit 20.

In the embodiment, the roller 31*a* and the roller 31*b* held at positions away from the projecting portion 32*a* at equal distance on the upstream side and the downstream side in the feeding direction in the roller holding body 32 press the roll body RT by the respective pressing force corresponding to the biasing force Fa or the biasing force Fb applied to the projecting portion 32*a*. In other words, the biasing force Fa or biasing force Fb is a resultant force of both pressing forces when the roller 31*a* and the roller 31*b* held by the roller holding body 32 press the roll body RT.

Incidentally, in the printer 11 according to the embodiment, in addition to supplying the roll sheet P3 unwound from the roll body RT to the printing unit 20, the first cut sheet P1 and the second cut sheet P2 are supplied to the printing unit 20 (refer to FIGS. 1 to 3). Therefore, in a case where the roll sheet P3 unwound from the roll body RT is supplied to the printing unit 20, the roll sheet P3 is rewound in the direction opposite to the feeding direction so that the roll sheet P3 does not interfere with the supply of the first cut sheet P1 and the second cut sheet P2 to the printing unit 20.

Figure 10:
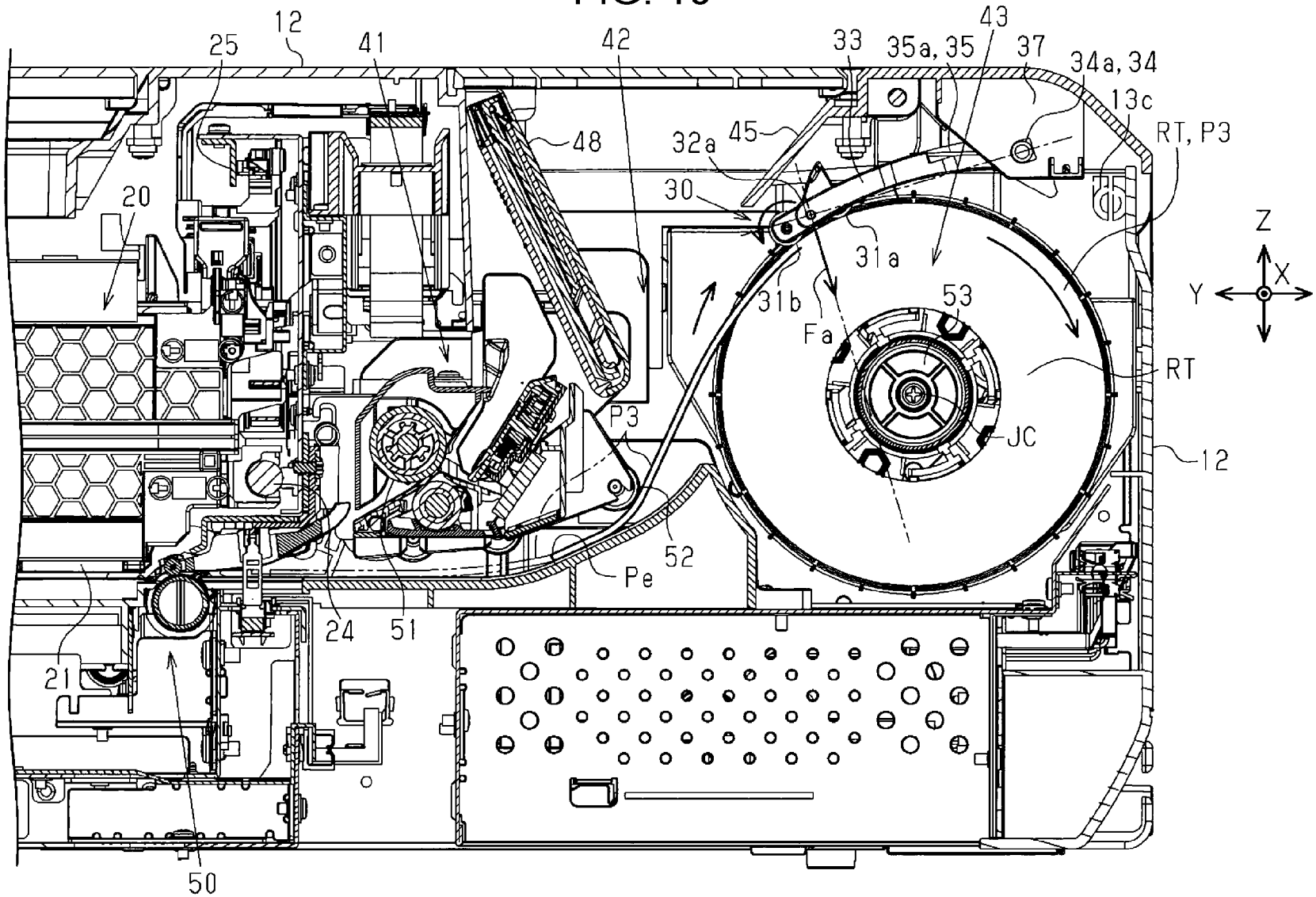
FIG. 10 is a side view showing a state where a recording medium is supplied from other than the roll body.

As shown in FIG. 10, for example, in a case where the first cut sheet P1 is supplied from the first sheet feed unit 41 to the printing unit 20 instead of the supplied roll sheet P3, the roll body RT is rotated, that is, inversely rotated, in a direction opposite to the direction at the time of feeding the roll sheet P3 (clockwise direction in FIG. 10) as shown by the solid arrow in FIG. 10. By the reverse rotation, the roll sheet P3 is rewound from a state shown by the two-dot chain line to a state shown by the solid line in FIG. 10, and the roll sheet P3 is in a standby position where the leading edge Pe thereof on the feeding direction side is on the downstream side of the guide roller 52 of the second sheet feed unit 42 in the feeding direction, and does not interfere with the first cut sheet P1 supplied from the first sheet feed unit 41 by the sheet feed roller 51.

Alternatively, although not shown here, in a case where the second cut sheet P2 is supplied from the second sheet feed unit 42 to the printing unit 20 instead of the supplied roll sheet P3, the roll body RT is rotated in a direction opposite to the feeding direction. By the rotation, the roll sheet P3 is in a standby position where the leading edge Pe thereof on the feeding direction side is on the upstream side of the guide roller 52 of the second sheet feed unit 42 in the feeding direction, and does not interfere with the second cut sheet P2 guided and supplied from the second sheet feed unit 42 by the guide roller 52.

Next, the operation of the printer 11 will be described with reference to FIGS. 9 and 10. In FIGS. 9 and 10, the thickness of the roll sheet P3 unwound from the roll body RT is exaggerated more than the actual thickness.

As shown in FIG. 9, in a case where the roll sheet P3 is supplied from the roll body RT, when the roll body RT starts to rotate (forward rotate), the rollers 31*a* and 31*b* of the pressing portion 30 that presses the roll sheet P3 start to rotate (be driven) with the movement of the roll sheet P3 in the feeding direction by the frictional force with the roll sheet P3. At this time, the frictional force for starting the rotation of the rollers 31*a* and 31*b* is a force that presses the portion of the roll sheet P3 in contact with the rollers 31*a* and 31*b* in a direction opposite to the feeding direction so as to unwind from the roll body RT.

At this time, the biasing direction of the biasing force Fa applied to the projecting portion 32*a* of the roller holding body 32 is a direction deviated from the axis JC (center of roll body RT) of the sheet feed shaft 53 toward the downstream side in the feeding direction. Therefore, the portion of the roll sheet P3 in contact with the rollers 31*a* and 31*b* is pressed in the feeding direction so as to be wound around the roll body RT by the biasing force Fa of the pressing portion 30. As a result, the biasing force Fa acts against the frictional force at the time of the start of rotation of the rollers 31*a* and 31*b*, and the roll sheet P3 supplied to the printing unit 20 is suppressed by the pressing portion 30 from being unwound from a state of being wound in the roll shape on the roll body RT.

The frictional force between the rollers 31*a* and 31*b* and the roll sheet P3 is smaller than the frictional force (static friction force) at the time of the start of rotation during the rotation of the roll body RT and acts in the feeding direction at the time of stopping the rotation. Therefore, it is possible to suppress the roll sheet P3 from being unwound from a state of being wound in the roll shape in the roll body RT.

On the other hand, as shown in FIG. 10, in a case where the roll sheet P3 is rewound around the roll body RT, when the roll body RT which has rotated (reverse rotated) at the end of the rewinding stops the rotation, the rollers 31*a* and 31*b* of the pressing portion 30 which is driven to rotate are decelerated. At this time, a force for unwinding from the roll body RT by pressing in the direction opposite to the feeding direction is acted by the frictional force between the rollers 31*a* and 31*b* and the roll sheet P3 with respect to the portion of roll sheet P3 in contact with the decelerating rollers 31*a* and 31*b*.

In the embodiment, the biasing direction of the biasing force Fa applied to the projecting portion 32*a* of the roller holding body 32 is a direction deviated from the axis JC of the sheet feed shaft 53 of the roll body RT toward the downstream side in the feeding direction. Therefore, the portion of the roll sheet P3 in contact with the rollers 31*a* and 31*b* is in a state of being pressed in the feeding direction so as to be wound around the roll body RT by the biasing force Fa of the pressing portion 30. As a result, the biasing force Fa acts against the frictional force at the time of stopping the rotation of the rollers 31*a* and 31*b*, and the roll sheet P3 is suppressed by the pressing portion 30 from being unwound from a state of being wound in the roll shape on the roll body RT.

The frictional force between the rollers 31*a* and 31*b* and the roll sheet P3 is smaller than the frictional force at the time of stopping the rotation during the rotation of the roll body RT and acts in the feeding direction at the time of the start of the rotation (reverse rotation) when the roll sheet P3 is rewound around the roll body RT. Therefore, it is possible to suppress the roll sheet P3 from being unwound from the state of being wound in the roll shape on the roll body RT.

According to the above embodiment, the following effects can be obtained.

(1) Since the pressing portion 30 presses the roll body RT in a direction opposite to a direction where the roll body RT is taken out from the third sheet feed unit 43, it is likely to maintain the roll body RT in a mounted state (mounted position).

(2) Since the pressing portion 30 presses the roll body RT in the direction deviated from the center of the roll body RT toward the downstream side in the feeding direction of the roll sheet P3, it is possible to suppress the roll sheet P3 wound in the roll shape from being unwound.

(3) Since the pressing portion 30 presses the roll body RT in conjunction with the movement of the sheet feed cover 13 to the closed position, by mounting the roll body RT on the third sheet feed unit 43 and thereafter closing the sheet feed cover 13 (first cover 13*a*), it is possible to reliably press the mounted roll body RT.

(4) Since the interval of the pressing portion 30 varies depending on the position in the width direction X, it is possible to appropriately press a plurality of roll bodies RT having different lengths in the width direction X.

The above embodiment may be modified as in the following modified example. In addition, the above embodiment and the following modified example may be arbitrarily combined.

In the above embodiment, the distance between the shaft portion 34 (shaft end 34*a*) of the lever body 33 and the pressing portion 30 may be longer than the distance between the shaft portion 34 (shaft end 34*a*) of the lever body 33 and the sheet feed shaft 53 of the roll body RT.

Figure 11:
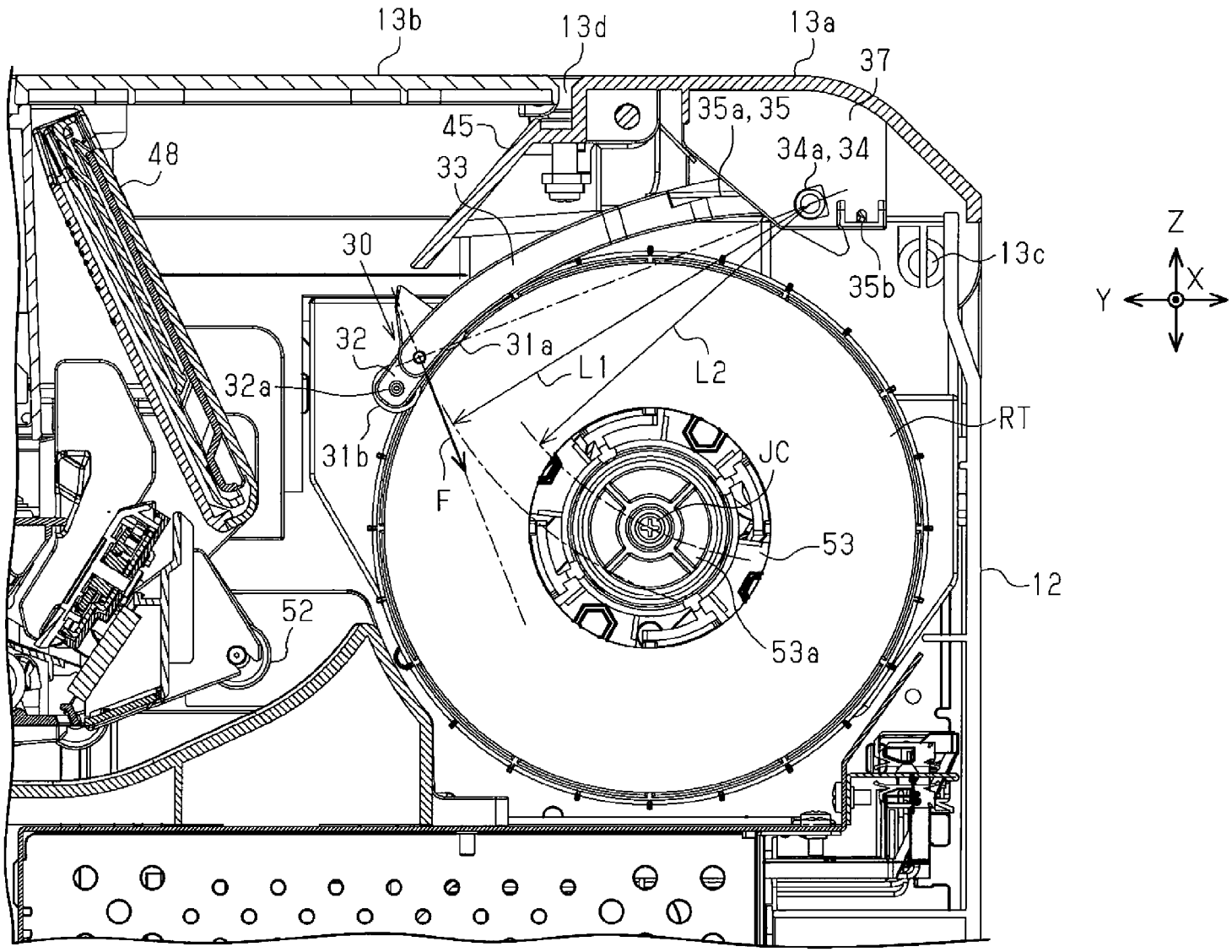
FIG. 11 is a side view showing a configuration relating to the pressing portion of a modified example.

As shown in FIG. 11, in the modified example, for example, the distance L1 between the center of the shaft portion 34 (shaft end 34*a*) of the lever body 33 and the center of the projecting portion 32*a* provided on the roller holding body 32 is longer than the distance L2 between the center of the shaft portion 34 (shaft end 34*a*) of the lever body 33 and the axial center JC of the sheet feed shaft 53 (shaft end portion 53*a*) which is the center of the roll body RT. In this manner, as shown by the solid arrow in FIG. 11, the biasing direction of the biasing force F that biases the projecting portion 32*a* of the roller holding body 32 by the lever body 33 biased by the biasing member 35 is a direction orthogonal to the direction of the straight line connecting the center of the shaft end 34*a* and the center of the projecting portion 32*a*. As a result, the pressing force with which the rollers 31*a* and 31*b* of the pressing portion 30 press the roll body RT is stable and a direction deviated from the center of the roll body RT (sheet feed shaft 53) toward the downstream side in the feeding direction of the roll sheet P3, while the diameter of the roll body RT changes from the maximum diameter to the minimum diameter.

In the modified example, the distance between the rotation center of the roller 31*a* on the upstream side in the feeding direction and the center of the shaft portion 34 (shaft end 34*a*) of the lever body 33 may be a length equal to or longer than the distance L2 between the center of the shaft portion 34 (shaft end 34*a*) of the lever body 33 and the axial center JC of the sheet feed shaft 53 (shaft end portion 53*a*). According to this configuration, the direction where both of the two rollers 31*a* and the rollers 31*b* press the roll body RT is stable and a direction deviated from the center of the roll body RT (sheet feed shaft 53) toward the downstream side in the feeding direction of the roll sheet P3.

According to this modification, the following effects are obtained in addition to the effects (1) to (4) in the above embodiment.

(5) In the pressing portion 30 attached to the lever body 33, it easy to press the roll body RT in a direction that is the downstream side in the feeding direction of the sheet P to the printing unit 20.

In the above embodiment, depending on the position in the width direction X that intersects with the feeding direction of the sheet P supplied to the printing unit 20, the plurality of pressing portions 30 may not necessarily be provided so that the intervals with the adjacent pressing portions 30 are different from each other. For example, all the intervals with the adjacent pressing portions 30 may be provided at the same interval.

In the above embodiment, the pressing portion 30 may not necessarily press the roll body RT in conjunction with the movement of the sheet feed cover 13 to the closed position. For example, the lever body 33 to which the pressing portion 30 is attached may be mounted so as to be capable of rocking with respect to the casing 12 instead of the first cover 13*a*. In this case, a rocking member that rocks the lever body 33 may be provided, and the lever body 33 may be rocked by the rocking member irrespective of the movement of the sheet feed cover 13.

In the above embodiment, the pressing portion 30 may not necessarily be attached to the rocking lever body 33. For example, the pressing portion 30 may be attached to a sliding member that slides in the vertical direction Z in a state of being biased downward by the biasing member. As a matter of course, in this case, the biasing direction of the biasing member is a direction where the pressing portion 30 presses the roll body RT toward the direction deviated from the center of the roll body RT toward the downstream side in the feeding direction of the roll sheet P3.

In the above embodiment, the pressing portion 30 may not necessarily press the roll body RT in a direction deviated from the center of the roll body RT toward the downstream side in the feeding direction of the roll sheet P3 when unwound from the roll body RT mounted on the third sheet feed unit 43 and supplied to the printing unit 20. For example, in a case where the friction with the roll sheet P3 wound around the roll body RT and overlapped is large, since it is difficult for the roll sheet P3 to be unwound, the pressing portion 30 may press the roll body RT toward the center of the roll body RT, and may press the roll body RT in a direction deviated from the center of the roll body RT toward the upstream side in the feeding direction of the roll sheet P3.

In the above embodiment, the pressing portion 30 may have one roller 31. In this case, one roller 31 may be attached so as to directly rotate with respect to the shaft hole provided in a Y-shaped portion formed on the leading end side of the lever body 33 without via the roller holding body 32. Alternatively, the pressing portion 30 may have three or more the plurality of rollers 31. In this case, the plurality of rollers 31 may be attached to the roller holding body 32 at equal intervals in the feeding direction (depth direction Y) of the roll sheet P3, and may be provided the projecting portions 32*a* attached to the lever body 33 at the center position in the feeding direction of the plurality of rollers 31 in the roller holding body 32.

In the above embodiment, although the two rollers 31 of the roller 31*a* and the roller 31*b* are rollers having the same shape, the rollers are not limited thereto, and for example, the roller 31*b* on the downstream side in the feeding direction may have a cylindrical (columnar) shape with a larger outer diameter (diameter) than the roller 31*a* on the upstream side in the feeding direction.

In the printer 11 of the above embodiment, a mounting portion that mounts the liquid container 28 at a position different from that of the carriage 22 may be provided. The mounting portion of the liquid container 28 may be provided inside the casing 12 or outside the casing 12.

In the above embodiment, the liquid can be arbitrarily selected as long as the liquid can be printed on the sheet P by adhering to the sheet P. The liquid may be a liquid in a state when the substance is in a liquid phase, and is a liquid containing a fluid substance such as a liquid material having high or low viscosity, sol, gel water, other inorganic solvent, organic solvent, solution, liquid resin, liquid metal (metal melt), and the like. In addition, the liquid includes not only a liquid as one state of a substance but also a substance in which a particle of a functional material containing a solid such as a pigment or a metal particle is dissolved, dispersed or mixed in a solvent, and the like. Representative examples of liquids include an ink. The ink includes various types of liquid compositions such as general water-based ink and oil-based ink, gel ink, hot melt ink, and the like.

In the above embodiment, the sheet P serving as a recording medium can be arbitrarily selected from high quality paper, medium quality paper, coated paper coated with paint on paper, Japanese paper, and the like. • The printer 11 of the above embodiment is an apparatus (recording apparatus) that prints images such as a character, a picture, a photograph, and the like by attaching a liquid such as an ink or a fluid such as a toner to the sheet P, and may include a serial printer, a lateral type printer, a line printer, a page printer, or the like. In addition, an offset printing apparatus, a textile printing apparatus, or the like may be included. In addition, the recording apparatus may have at least a printing function of printing on the recording medium, and may be a multifunctional machine having functions other than a printing function.

This application claims priority under 35 U.S.C. § 119 to Japanese Patent Application No. 2017-070264, filed Mar. 31, 2017. The entire disclosure of Japanese Patent Application No. 2017-070264 is hereby incorporated herein by reference.

What is claimed is:

1. A recording apparatus comprising:

a recording unit that performs a recording on a recording medium;

a medium supply unit that mounts a roll body on which the recording medium is wound in a roll shape, unwinds the recording medium from the roll body, and supplies the recording medium to the recording unit; and a pressing portion that presses the roll body mounted on the medium supply unit, wherein the pressing portion presses the mounted roll body in a direction opposite to a direction of taking out the roll body from the medium supply unit, and wherein a plurality of the pressing portions are disposed at intervals in a width direction intersecting a feeding direction of the recording medium supplied to the recording unit, and the intervals are different from each other depending on positions in the width direction.

2. The recording apparatus according to claim 1, wherein the pressing portion presses the roll body in a direction deviated from a center of the roll body toward a downstream side in a feeding direction of the recording medium when the recording medium is unwound from the roll body mounted on the medium supply unit and supplied to the recording unit.

3. The recording apparatus according to claim 1, wherein the pressing portion is attached to a rocking lever that can rock around a rocking axis, and a distance between the rocking axis of the rocking lever and the pressing portion is longer than a distance between the rocking axis of the rocking lever and a cylindrical shaft of the roll body.

4. The recording apparatus according to claim 1, further comprising:

an opening/closing cover that is movable between a closed position covering the mounted roll body and an open position exposing the mounted roll body, wherein the pressing portion presses the roll body in conjunction with a movement of the opening/closing cover to the closed position.

5. A recording apparatus comprising:

a recording unit that performs a recording on a recording medium;

a medium supply unit that mounts a roll body on which the recording medium is wound in a roll shape, unwinds the recording medium from the roll body, and supplies the recording medium to the recording unit, and winds the recording medium; and a plurality of pressing portions that are arranged in width direction intersecting a feeding direction of the recording medium and that presses the roll body mounted on the medium supply unit, wherein the plurality of pressing portions presses the mounted roll body in a direction opposite to a direction of taking out the roll body from the medium supply unit, wherein the medium supply unit mounts a sheet feed shaft serving as a cylindrical shaft of the roll body, and wherein the medium supply unit winds and unwinds the recording medium by rotating the cylindrical shaft.

* * * * *